US011414798B2

(12) United States Patent
Cabell et al.

(10) Patent No.: US 11,414,798 B2
(45) Date of Patent: Aug. 16, 2022

(54) FIBROUS STRUCTURES

(71) Applicant: The Procter & Gamble Company, Cincinnati, OH (US)

(72) Inventors: David William Cabell, Cincinnati, OH (US); Paul Dennis Trokhan, Hamilton, OH (US); Steven Lee Barnholtz, West Chester, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 115 days.

(21) Appl. No.: 17/015,399

(22) Filed: Sep. 9, 2020

(65) Prior Publication Data

US 2020/0399803 A1 Dec. 24, 2020

Related U.S. Application Data

(62) Division of application No. 12/170,557, filed on Jul. 10, 2008, now abandoned.

(60) Provisional application No. 61/065,319, filed on Feb. 11, 2008, provisional application No. 60/959,884, filed on Jul. 17, 2007, provisional application No. 60/959,813, filed on Jul. 17, 2007, provisional application No. 60/959,885, filed on Jul. 17, 2007, provisional application No. 60/959,809, filed on Jul. 17, 2007.

(51) Int. Cl.

| | |
|---|---|
| ***D04H 5/00*** | (2012.01) |
| ***D04H 5/02*** | (2012.01) |
| ***D04H 1/425*** | (2012.01) |
| ***D04H 1/732*** | (2012.01) |
| ***D21H 13/10*** | (2006.01) |
| ***D04H 1/435*** | (2012.01) |
| ***D21H 27/00*** | (2006.01) |
| ***D04H 1/4382*** | (2012.01) |

(52) U.S. Cl.

CPC ..... *D04H 5/02* (2013.01); *D04H 1/425* (2013.01); *D04H 1/435* (2013.01); *D04H 1/43825* (2020.05); *D04H 1/43835* (2020.05); *D04H 1/732* (2013.01); *D21H 13/10* (2013.01); *D21H 27/002* (2013.01); *Y10T 428/268* (2015.01)

(58) Field of Classification Search

CPC ..... D04H 5/00

See application file for complete search history.

(56) References Cited

U.S. PATENT DOCUMENTS

| | | | |
|---|---|---|---|
| 2,008,031 | A | 7/1935 | Arthur |
| 2,175,045 | A | 10/1939 | Rudolf |
| 3,521,638 | A | 7/1970 | Parrish |

(Continued)

FOREIGN PATENT DOCUMENTS

| | | | |
|---|---|---|---|
| DE | 19959832 | A1 | 7/2001 |
| EP | 0080382 | A1 | 6/1983 |

(Continued)

OTHER PUBLICATIONS

Complete Textile Glossary, Celaneses Acetate (2001), definition of "filament".

(Continued)

*Primary Examiner* — Andrew T Piziali

(74) *Attorney, Agent, or Firm* — C. Brant Cook

(57) ABSTRACT

Fibrous structures containing a mixture of three or more different fibrous elements (filaments and/or fibers) are provided.

20 Claims, 7 Drawing Sheets

(56) References Cited

U.S. PATENT DOCUMENTS 3,772,739 A 11/1973 Lovgren
3,838,692 A 10/1974 Levesque
3,954,361 A 5/1976 Page
4,083,913 A 4/1978 Marshall
4,100,324 A 7/1978 Anderson et al.
4,118,531 A 10/1978 Hauser
4,139,699 A 2/1979 Hernandez et al.
4,203,939 A 5/1980 Drachenberg et al.
4,231,768 A * 11/1980 Seibert ..... B01D 39/14 210/DIG. 5
4,243,480 A 1/1981 Hernandez et al.
4,355,066 A 10/1982 Newman
4,370,289 A 1/1983 Sorenson
4,436,780 A 3/1984 Hotchkiss et al.
4,604,313 A 8/1986 Mcfarland et al.
4,623,576 A 11/1986 Lloyd et al.
4,634,621 A 1/1987 Manning et al.
4,636,418 A 1/1987 Kennard et al.
4,675,226 A 6/1987 Ott
4,720,415 A 1/1988 Vander
4,724,114 A 2/1988 Mcfarland et al.
4,786,550 A 11/1988 Mcfarland et al.
4,803,117 A 2/1989 Daponte
4,851,168 A 7/1989 Graiver et al.
4,855,179 A 8/1989 Bourland et al.
4,863,779 A 9/1989 Daponte
4,879,170 A 11/1989 Radwanski et al.
4,885,202 A 12/1989 Lloyd et al.
4,906,513 A 3/1990 Kebbell et al.
4,931,355 A 6/1990 Radwanski et al.
4,939,016 A 7/1990 Radwanski et al.
4,970,104 A 11/1990 Radwanski
4,971,742 A 11/1990 Brooks et al.
5,087,506 A 2/1992 Palumbo
5,120,888 A 6/1992 Nohr
5,145,727 A 9/1992 Potts et al.
5,149,576 A 9/1992 Potts et al.
5,204,165 A 4/1993 Schortmann
5,227,107 A 7/1993 Dickenson et al.
5,240,764 A * 8/1993 Haid ..... D21H 25/005 28/104
5,254,399 A 10/1993 Oku et al.
5,272,236 A 12/1993 Lai et al.
5,284,703 A 2/1994 Everhart et al.
5,350,624 A 9/1994 Georger et al.
5,375,306 A 12/1994 Roussin-moynier
5,409,768 A 4/1995 Dickenson et al.
5,427,696 A 6/1995 Phan et al.
5,436,066 A 7/1995 Chen
5,476,616 A 12/1995 Schwarz
5,508,079 A * 4/1996 Grant ..... D04H 3/02 52/406.1
5,508,102 A 4/1996 Georger et al.
5,509,915 A 4/1996 Hanson
5,536,563 A 7/1996 Shah et al.
5,539,056 A 7/1996 Yang et al.
5,576,358 A * 11/1996 Lem ..... B29C 43/006 204/157.43
5,587,225 A 12/1996 Griesbach et al.
5,597,873 A 1/1997 Chambers et al.
5,611,890 A 3/1997 Vinson et al.
5,629,080 A 5/1997 Gupta et al.
5,641,563 A 6/1997 Truong et al.
5,652,048 A 7/1997 Haynes et al.
5,783,780 A * 7/1998 Watanabe ..... F02M 35/1261 181/252
5,811,178 A 9/1998 Adam et al.
5,814,570 A 9/1998 Cohen
5,843,557 A * 12/1998 Sternlieb ..... B32B 5/06 428/110
5,853,867 A 12/1998 Harada et al.
5,948,710 A 9/1999 Pomplun et al.
5,952,251 A 9/1999 Jackson et al.
6,103,061 A 8/2000 Anderson et al.
6,150,005 A 11/2000 Williams et al.
6,172,276 B1 1/2001 Hetzler et al.
6,177,370 B1 1/2001 Skoog et al.
6,179,325 B1 1/2001 Igawa
6,200,120 B1 3/2001 Fish et al.
6,296,936 B1 10/2001 Yahiaoui et al.
6,319,342 B1 11/2001 Riddell
6,348,133 B1 2/2002 Woodrum
6,348,253 B1 2/2002 Daley et al.
6,383,336 B1 5/2002 Shannon
6,417,120 B1 7/2002 Mitchler et al.
6,423,884 B1 7/2002 Oehmen
6,465,073 B1 10/2002 Morman
6,488,801 B1 12/2002 Bodaghi et al.
6,494,974 B2 12/2002 Riddell
6,503,370 B2 1/2003 Hollmark et al.
6,506,873 B1 1/2003 Ryan et al.
6,550,115 B1 4/2003 Skoog et al.
6,589,892 B1 7/2003 Smith et al.
6,608,236 B1 8/2003 Burnes et al.
6,621,679 B1 9/2003 Segervall
6,686,303 B1 2/2004 Haynes et al.
6,709,526 B1 3/2004 Bailey et al.
6,739,023 B2 5/2004 Vonfeldt et al.
6,759,356 B1 7/2004 Myers
6,797,226 B2 9/2004 Annable
6,811,638 B2 11/2004 Close et al.
6,823,568 B1 11/2004 Kobayashi et al.
6,836,937 B1 1/2005 Boscolo
6,946,413 B2 9/2005 Lange et al.
6,979,386 B1 12/2005 Wallajapet et al.
6,986,932 B2 1/2006 Zink et al.
6,992,028 B2 1/2006 Thomaschefsky et al.
7,000,000 B1 2/2006 Obrien
7,028,429 B1 4/2006 Druliner
7,029,620 B2 4/2006 Gordon et al.
7,041,369 B1 5/2006 Mackey et al.
7,176,150 B2 2/2007 Kopacz et al.
7,410,683 B2 8/2008 Curro et al.
7,425,517 B2 9/2008 Deka et al.
7,696,109 B2 4/2010 Ouellette et al.
7,879,172 B2 2/2011 Kopacz et al.
7,902,096 B2 3/2011 Brandner et al.
7,972,986 B2 7/2011 Barnholtz et al.
7,994,079 B2 8/2011 Chen et al.
7,994,081 B2 8/2011 Farell et al.
7,998,889 B2 8/2011 Stralin et al.
8,017,534 B2 9/2011 Harvey et al.
2003/0024662 A1 2/2003 Besemer et al.
2003/0073367 A1 4/2003 Kopacz et al.
2003/0106568 A1 6/2003 Keck
2003/0131457 A1 7/2003 Krautkramer et al.
2003/0135172 A1 7/2003 Whitmore et al.
2003/0150090 A1 8/2003 Krautkramer et al.
2003/0200991 A1 10/2003 Keck
2003/0220039 A1 11/2003 Chen et al.
2004/0048542 A1 3/2004 Thomaschefsky et al.
2004/0065422 A1 4/2004 Hu et al.
2004/0087237 A1 5/2004 Garnier et al.
2004/0096656 A1 5/2004 Bond
2004/0106723 A1 6/2004 Yang et al.
2004/0163781 A1 8/2004 Hernandez-munoa et al.
2004/0181199 A1 9/2004 Moberg-alehammar et al.
2005/0020170 A1 1/2005 Deka et al.
2005/0056956 A1 3/2005 Zhao et al.
2005/0090175 A1 4/2005 Bergholm et al.
2005/0103455 A1 5/2005 Edwards et al.
2005/0112980 A1 5/2005 Strandqvist et al.
2005/0130536 A1 6/2005 Siebers et al.
2005/0130544 A1 6/2005 Cheng et al.
2005/0133177 A1 6/2005 Stralin et al.
2005/0136765 A1 6/2005 Shannon
2005/0136772 A1 6/2005 Chen et al.
2005/0136778 A1 6/2005 Thomaschefsky et al.
2005/0137540 A1 6/2005 Villanueva et al.
2005/0148264 A1 7/2005 Varona et al.
2005/0159065 A1 7/2005 Stralin et al.
2005/0170727 A1 8/2005 Melik et al.
2005/0177122 A1 8/2005 Berba et al.

(56) References Cited

U.S. PATENT DOCUMENTS

| | | | |
|---|---|---|---|
| 2005/0245159 | A1 | 11/2005 | Chmielewski et al. |
| 2005/0247416 | A1 | 11/2005 | Forry et al. |
| 2005/0274470 | A1 | 12/2005 | Shannon et al. |
| 2006/0070294 | A1 | 4/2006 | Spittle |
| 2006/0086633 | A1 | 4/2006 | Kleinsmith |
| 2006/0088697 | A1 | 4/2006 | Manifold et al. |
| 2007/0010153 | A1 | 1/2007 | Shaffer et al. |
| 2007/0039704 | A1 | 2/2007 | Cabell et al. |
| 2007/0049153 | A1 | 3/2007 | Dunbar et al. |
| 2007/0063091 | A1 | 3/2007 | Neveu |
| 2007/0077841 | A1 | 4/2007 | Zoch et al. |
| 2007/0173162 | A1 | 7/2007 | Ethiopia et al. |
| 2007/0202766 | A1 | 8/2007 | Ouellette et al. |
| 2007/0232180 | A1 | 10/2007 | Polat et al. |
| 2007/0272381 | A1 | 11/2007 | Elony et al. |
| 2008/0000602 | A1 | 1/2008 | Dyer et al. |
| 2008/0008853 | A1 | 1/2008 | Hupp et al. |
| 2008/0041543 | A1 | 2/2008 | Dyer |
| 2008/0050996 | A1 | 2/2008 | Stralin et al. |
| 2008/0051471 | A1 | 2/2008 | Kronberg et al. |
| 2008/0142178 | A1 | 6/2008 | Haubrich et al. |
| 2008/0241538 | A1 | 10/2008 | Lee et al. |
| 2008/0248239 | A1 | 10/2008 | Pomeroy et al. |
| 2009/0022960 | A1 | 1/2009 | Suer et al. |
| 2009/0022983 | A1 | 1/2009 | Cabell et al. |
| 2009/0023839 | A1 | 1/2009 | Barnholtz et al. |
| 2009/0084513 | A1 | 4/2009 | Barnholtz et al. |
| 2009/0151748 | A1 | 6/2009 | Ridenhour |
| 2009/0220741 | A1 | 9/2009 | Manifold |
| 2009/0220769 | A1 | 9/2009 | Manifold |
| 2010/0239825 | A1 | 9/2010 | Sheehan et al. |
| 2010/0326612 | A1 | 12/2010 | Hupp et al. |
| 2011/0100574 | A1 | 5/2011 | Barnholtz et al. |
| 2011/0104419 | A1 | 5/2011 | Barnholtz et al. |
| 2011/0104444 | A1 | 5/2011 | Barnholtz et al. |
| 2011/0104493 | A1 | 5/2011 | Barnholtz et al. |
| 2011/0104970 | A1 | 5/2011 | Barnholtz et al. |
| 2011/0209840 | A1 | 9/2011 | Barnholtz et al. |
| 2011/0220310 | A1 | 9/2011 | Polat et al. |
| 2011/0244199 | A1 | 10/2011 | Brennan et al. |
| 2020/0399803 | A1 | 12/2020 | Cabell et al. |

FOREIGN PATENT DOCUMENTS

| | | | |
|---|---|---|---|
| EP | 0156649 | A2 | 10/1985 |
| EP | 0294137 | A1 | 12/1988 |
| EP | 0341977 | A2 | 11/1989 |
| EP | 0357496 | B1 | 5/1994 |
| EP | 0205242 | B2 | 11/1995 |
| EP | 0590307 | B1 | 12/1998 |
| EP | 1156147 | A1 | 11/2001 |
| EP | 1156160 | A2 | 11/2001 |
| EP | 1300511 | A2 | 4/2003 |
| EP | 1589137 | A1 | 10/2005 |
| EP | 1887036 | A2 | 2/2008 |
| EP | 1504145 | B1 | 11/2008 |
| GB | 2113731 | A | 8/1983 |
| JP | 59211667 | A | 11/1984 |
| JP | 08174735 | A | 7/1996 |
| JP | 2000303335 | A | 10/2000 |
| JP | 2002088660 | A | 3/2002 |
| JP | 2004141255 | A | 5/2004 |
| JP | 2005218525 | A | 8/2005 |
| WO | 9207985 | A1 | 5/1992 |
| WO | 9419179 | A1 | 9/1994 |
| WO | 9737757 | A1 | 10/1997 |
| WO | 9827257 | A2 | 6/1998 |
| WO | 9836117 | A1 | 8/1998 |
| WO | 0011998 | A1 | 3/2000 |
| WO | 0029655 | A1 | 5/2000 |
| WO | 0038565 | A1 | 7/2000 |
| WO | 0063486 | A1 | 10/2000 |
| WO | 0109023 | A1 | 2/2001 |
| WO | 0250357 | A1 | 6/2002 |
| WO | 02053003 | A2 | 7/2002 |
| WO | 02053365 | A2 | 7/2002 |
| WO | 03050347 | A1 | 6/2003 |
| WO | 03080905 | A1 | 10/2003 |
| WO | 2004092474 | A2 | 10/2004 |
| WO | 2005065516 | A2 | 7/2005 |
| WO | 2005106085 | A1 | 11/2005 |
| WO | 2005118934 | A1 | 12/2005 |
| WO | 2006027810 | A1 | 3/2006 |
| WO | 2007070064 | A1 | 6/2007 |
| WO | 2007070075 | A1 | 6/2007 |
| WO | 2007078344 | A1 | 7/2007 |
| WO | 2007098449 | A1 | 8/2007 |
| WO | 2007100936 | A2 | 9/2007 |
| WO | 2007124866 | A1 | 11/2007 |
| WO | 2007135624 | A2 | 11/2007 |
| WO | 2008005500 | A2 | 1/2008 |
| WO | 2008050311 | A2 | 5/2008 |
| WO | 2008073101 | A1 | 6/2008 |
| WO | 2009010940 | A2 | 1/2009 |
| WO | 2009010941 | A2 | 1/2009 |
| WO | 2009010942 | A2 | 1/2009 |
| WO | 2009105490 | A1 | 8/2009 |

OTHER PUBLICATIONS

International Search Report and Written Opinion; Application Ser. No. PCT/IB2008/052891; dated Mar. 26, 2019, 14 pages.
Final Office Action; U.S. Appl. No. 12/170,557 dated Apr. 7, 2020.
Final Office Action; U.S. Appl. No. 12/170,557 dated Apr. 18, 2011.
Final Office Action; U.S. Appl. No. 12/170,557 dated Feb. 24, 2012.
Final Office Action; U.S. Appl. No. 12/170,557 dated Oct. 6, 2014.
Final Office Action; U.S. Appl. No. 12/170,557 dated Apr. 13, 2017.
Final Office Action; U.S. Appl. No. 12/170,557 dated Apr. 25, 2018.
Final Office Action; U.S. Appl. No. 12/170,557 dated Mar. 1, 2016.
Final Office Action; U.S. Appl. No. 12/170,557 dated May 2, 2019.
Non Final Office Action; U.S. Appl. No. 12/170,557 dated Dec. 29, 2010.
Non Final Office Action; U.S. Appl. No. 12/170,557 dated Dec. 21, 2016.
Non Final Office Action; U.S. Appl. No. 12/170,557 dated Jan. 18, 2019.
Non Final Office Action; U.S. Appl. No. 12/170,557 dated Jun. 3, 2014.
Non Final Office Action; U.S. Appl. No. 12/170,557 dated Oct. 18, 2011.
Non Final Office Action; U.S. Appl. No. 12/170,557 dated Oct. 24, 2019.
Non Final Office Action; U.S. Appl. No. 12/170,557 dated Jan. 9, 2018.
Non Final Office Action; U.S. Appl. No. 12/170,557 dated Oct. 1, 2015.

* cited by examiner

FIBROUS STRUCTURES

FIELD OF THE INVENTION

The present invention relates to fibrous structures and more particularly to fibrous structures comprising a mixture of three or more different fibrous elements (filaments and/or fibers), especially a mixture of three or more fibrous elements that provide different benefits from one another for the fibrous structures.

BACKGROUND OF THE INVENTION

Fibrous structures that comprise three or more different fibrous elements are known in the art. For example, commercially available baby care wipe products include rayon (cellulose) fibers, pulp (cellulose) fibers and polypropylene filaments. Such known fibrous structures, however, exhibit performance issues that have yet to be solved in a fibrous structure comprising three or more different fibrous elements.

The problem faced by formulators of fibrous structures is that consumers of fibrous structures, especially sanitary tissue products comprising fibrous structures, desire more and different performance and/or properties from a fibrous structure. Oftentimes the properties consumers desire are inversely related. For example, in the past, if consumers wanted greater softness then the fibrous structure would need to be less strong and vice versa. In addition, if consumers desired greater wet strength then the fibrous structures would need to be less absorbent, for example more hydrophobic, and vice versa.

Accordingly, there is a need for new fibrous structures that provide consumers desired performance and/or properties to meet their use needs.

SUMMARY OF THE INVENTION

The present invention solves the problem described above by providing a fibrous structure comprising a mixture of three or more different fibrous elements, wherein the fibrous structure meets the performance and/or property needs of the consumers of fibrous structures, especially sanitary tissue product consumers.

In one example of the present invention, a fibrous structure comprising:

a. a non-thermoplastic, first fibrous element, wherein the first fibrous element exhibits a length to average diameter ratio of greater than 2000 and/or a length to effective diameter ratio of greater than 2000;

b. a second fibrous element different from the first fibrous element; and c. a third fibrous element different from the first and second fibrous elements is provided.

In another example of the present invention, a fibrous structure comprising:

a. a first fibrous element comprising a random mixture of different polymers wherein at least one of the polymers is a biodegradable polymer, wherein the first fibrous element exhibits a length to average diameter ratio of greater than 2000 and/or a length to effective diameter ratio of greater than 2000;

b. a second fibrous element different from the first fibrous element; and c. a third fibrous element different from the first and second fibrous elements is provided.

In yet another example of the present invention, a fibrous structure comprising:

a. a first fibrous element comprising a filament comprising a random mixture of different polymers wherein at least one of the polymers is a biodegradable polymer;

b. a second fibrous element different from the first fibrous element; and c. a third fibrous element different from the first and second fibrous elements is provided.

In yet another example of the present invention, a fibrous structure comprising:

a. a non-thermoplastic, first fibrous element comprising a filament;

b. a second fibrous element different from the first fibrous element; and c. a third fibrous element different from the first and second fibrous elements is provided.

In still yet another example of the present invention, a fibrous structure comprising:

a. a non-thermoplastic, non-cellulose-containing first fibrous element;

b. a second fibrous element different from the first fibrous element; and c. a third fibrous element different from the first and second fibrous elements is provided.

In another example of the present invention, a fibrous structure comprising:

a. a non-cellulose-containing first fibrous element comprising a random mixture of different polymers wherein at least one of the polymers is a biodegradable polymer;

b. a second fibrous element different from the first fibrous element; and c. a third fibrous element different from the first and second fibrous elements is provided.

In even yet another example of the present invention, a fibrous structure comprising:

a. a non-cellulose-containing first fibrous element comprising a filament comprising a random mixture of different polymers wherein at least one of the polymers is a biodegradable polymer;

b. a second fibrous element different from the first fibrous element; and c. a third fibrous element different from the first and second fibrous elements is provided.

In even still yet another example of the present invention, a fibrous structure comprising:

a. a non-thermoplastic, non-cellulose-containing first fibrous element comprising a filament;

b. a second fibrous element different from the first fibrous element; and c. a third fibrous element different from the first and second fibrous elements is provided.

Accordingly, the present invention provides fibrous structures comprising a mixture of three or more fibrous elements that are different from one another.

DETAILED DESCRIPTION OF THE INVENTION

Definitions

Figure 1:
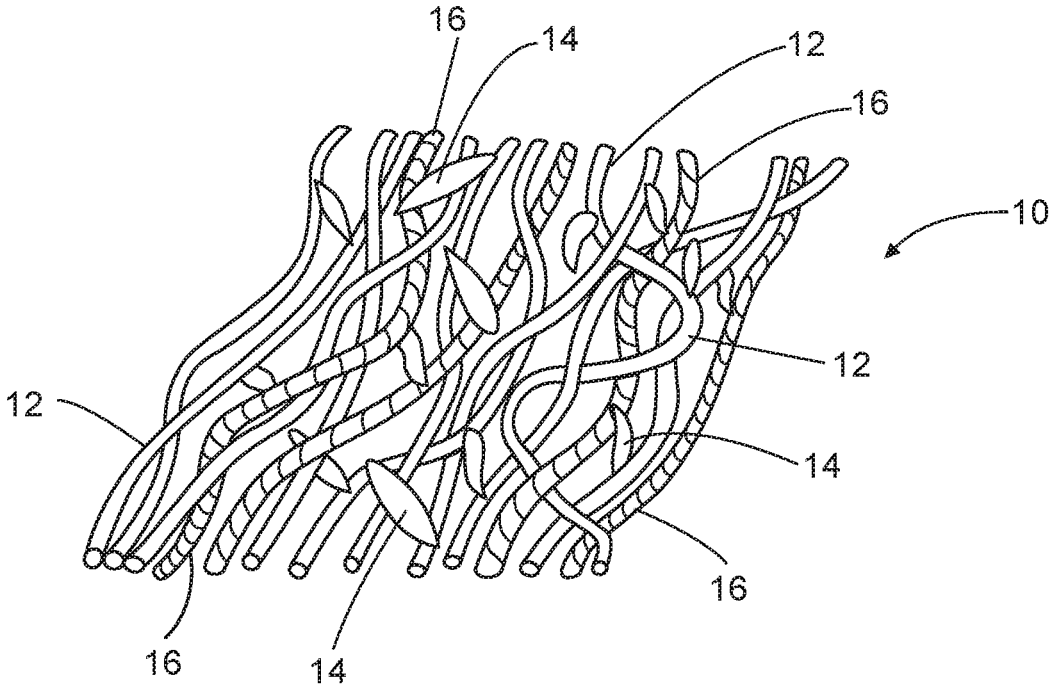
FIG. 1 is a schematic representation of an example of a fibrous structure according to the present invention.

"Fibrous structure" as used herein means a structure that comprises one or more fibrous elements. In one example, a fibrous structure according to the present invention means an association of fibrous elements that together form a structure, such as a unitary structure, capable of performing a function. Nonlimiting examples of fibrous structures of the present invention include paper, fabrics (including woven, knitted, and non-woven).

The fibrous structures of the present invention may be homogeneous or may be layered. If layered, the fibrous structures may comprise at least two and/or at least three and/or at least four and/or at least five layers.

The fibrous structures of the present invention may be co-formed fibrous structures.

In one example, the fibrous structures of the present invention are disposable. For example, the fibrous structures of the present invention are non-textile fibrous structures. In another example, the fibrous structures of the present invention are flushable, such as toilet tissue.

Nonlimiting examples of processes for making fibrous structures include known wet-laid papermaking processes and air-laid papermaking processes. Such processes typically include the steps of preparing a fibrous element composition, such as a fiber composition, in the form of a suspension in a medium, either wet, more specifically an aqueous medium, i.e., water, or dry, more specifically a gaseous medium, i.e. air. The suspension of fibers within an aqueous medium is oftentimes referred to as a fiber slurry. The fibrous suspension is then used to deposit a plurality of fibers onto a forming wire or belt such that an embryonic fibrous structure is formed, after which drying and/or bonding the fibers together results in the association of the fibers into a fibrous structure. Further processing the fibrous structure may be carried out such that a finished fibrous structure is formed. For example, in typical papermaking processes, the finished fibrous structure is the fibrous structure that is wound on the reel at the end of papermaking. The finished fibrous structure may subsequently be converted into a finished product, e.g. a sanitary tissue product.

In one example, the fibrous structure of the present invention is a "unitary fibrous structure."

"Unitary fibrous structure" as used herein is an arrangement comprising a plurality of two or more and/or three or more fibrous elements that are inter-entangled or otherwise associated with one another to form a fibrous structure. A unitary fibrous structure in accordance with the present invention may be incorporated into a fibrous structure according to the present invention. A unitary fibrous structure of the present invention may be one or more plies within a multi-ply fibrous structure. In one example, a unitary fibrous structure of the present invention may comprise three or more different fibrous elements. In another example, a unitary fibrous structure of the present invention may comprise two different fibrous elements, for example a co-formed fibrous structure, upon which a different fibrous element is deposited to form a fibrous structure comprising three or more different fibrous elements.

"Co-formed fibrous structure" as used herein means that the fibrous structure comprises a plurality of filaments and a plurality of fibers. In one example, a co-formed fibrous structure comprises starch filaments and wood pulp fibers.

"Fibrous element" as used herein means an elongate particulate having a length greatly exceeding its average diameter, i.e. a length to average diameter ratio of at least about 10. A fibrous element may be a filament or a fiber. In one example, the fibrous element is a single fibrous element rather than a yarn comprising a plurality of fibrous elements.

The fibrous elements of the present invention may be spun from polymer melt compositions via suitable spinning operations, such as meltblowing and/or spunbonding and/or they may be obtained from natural sources such as vegetative sources, for example trees.

The fibrous elements of the present invention may be monocomponent and/or multicomponent. For example, the fibrous elements may comprise bicomponent fibers and/or filaments. The bicomponent fibers and/or filaments may be in any form, such as side-by-side, core and sheath, islands-in-the-sea and the like.

"Filament" as used herein means an elongate particulate as described above that exhibits a length of greater than or equal to 5.08 cm (2 in.) and/or greater than or equal to 7.62 cm (3 in.) and/or greater than or equal to 10.16 cm (4 in.) and/or greater than or equal to 15.24 cm (6 in.).

Filaments are typically considered continuous or substantially continuous in nature. Filaments are relatively longer than fibers. Nonlimiting examples of filaments include meltblown and/or spunbond filaments. Nonlimiting examples of polymers that can be spun into filaments include natural polymers, such as starch, starch derivatives, cellulose, such as rayon and/or lyocell, and cellulose derivatives, hemicellulose, hemicellulose derivatives, and synthetic polymers including, but not limited to thermoplastic polymer filaments, such as polyesters, nylons, polyolefins such as polypropylene filaments, polyethylene filaments, and biodegradable thermoplastic fibers such as polylactic acid filaments, polyhydroxyalkanoate filaments, polyesteramide filaments and polycaprolactone filaments.

"Fiber" as used herein means an elongate particulate as described above that exhibits a length of less than 5.08 cm (2 in.) and/or less than 3.81 cm (1.5 in.) and/or less than 2.54 cm (1 in.).

Fibers are typically considered discontinuous in nature. Nonlimiting examples of fibers include pulp fibers, such as wood pulp fibers, and synthetic staple fibers such as polypropylene, polyethylene, polyester, copolymers thereof, rayon, glass fibers and polyvinyl alcohol fibers.

Staple fibers may be produced by spinning a filament tow and then cutting the tow into segments of less than 5.08 cm (2 in.) thus producing fibers.

In one example of the present invention, a fiber may be a naturally occurring fiber, which means it is obtained from a naturally occurring source, such as a vegetative source, for example a tree and/or plant. Such fibers are typically used in papermaking and are oftentimes referred to as papermaking fibers. Papermaking fibers useful in the present invention include cellulosic fibers commonly known as wood pulp fibers. Applicable wood pulps include chemical pulps, such as Kraft, sulfite, and sulfate pulps, as well as mechanical pulps including, for example, groundwood, thermomechanical pulp and chemically modified thermomechanical pulp. Chemical pulps, however, may be preferred since they impart a superior tactile sense of softness to tissue sheets made therefrom. Pulps derived from both deciduous trees (hereinafter, also referred to as "hardwood") and coniferous trees (hereinafter, also referred to as "softwood") may be utilized. The hardwood and softwood fibers can be blended, or alternatively, can be deposited in layers to provide a stratified web. Also applicable to the present invention are fibers derived from recycled paper, which may contain any or all of the above categories of fibers as well as other non-fibrous polymers such as fillers, softening agents, wet and dry strength agents, and adhesives used to facilitate the original papermaking.

In addition to the various wood pulp fibers, other cellulosic fibers such as cotton linters, rayon, lyocell and bagasse fibers can be used in the fibrous structures of the present invention.

"Sanitary tissue product" as used herein means a soft, low density (i.e. <about 0.15 g/cm3) fibrous structure useful as a wiping implement for post-urinary and post-bowel movement cleaning (toilet tissue), for otorhinolaryngological discharges (facial tissue), and multi-functional absorbent and cleaning uses (absorbent towels). The sanitary tissue product may be convolutedly wound upon itself about a core or without a core to form a sanitary tissue product roll.

In one example, the sanitary tissue product of the present invention comprises one or more fibrous structures according to the present invention.

The sanitary tissue products of the present invention may exhibit a basis weight between about 10 g/m$^2$ to about 120 g/m$^2$ and/or from about 15 g/m$^2$ to about 110 g/m$^2$ and/or from about 20 g/m$^2$ to about 100 g/m$^2$ and/or from about 30 to 90 g/m$^2$. In addition, the sanitary tissue product of the present invention may exhibit a basis weight between about 40 g/m$^2$ to about 120 g/m$^2$ and/or from about 50 g/m$^2$ to about 110 g/m$^2$ and/or from about 55 g/m$^2$ to about 105 g/m$^2$ and/or from about 60 to 100 g/m$^2$.

The sanitary tissue products of the present invention may exhibit a total dry tensile strength of greater than about 59 g/cm (150 g/in) and/or from about 78 g/cm (200 g/in) to about 394 g/cm (1000 g/in) and/or from about 98 g/cm (250 g/in) to about 335 g/cm (850 g/in). In addition, the sanitary tissue product of the present invention may exhibit a total dry tensile strength of greater than about 196 g/cm (500 g/in) and/or from about 196 g/cm (500 g/in) to about 394 g/cm (1000 g/in) and/or from about 216 g/cm (550 g/in) to about 335 g/cm (850 g/in) and/or from about 236 g/cm (600 g/in) to about 315 g/cm (800 g/in). In one example, the sanitary tissue product exhibits a total dry tensile strength of less than about 394 g/cm (1000 g/in) and/or less than about 335 g/cm (850 g/in).

In another example, the sanitary tissue products of the present invention may exhibit a total dry tensile strength of greater than about 500 g/in and/or greater than about 600 g/in and/or greater than about 700 g/in and/or greater than about 800 g/in and/or greater than about (900 g/in) and/or greater than about 394 g/cm (1000 g/in) and/or from about 315 g/cm (800 g/in) to about 1968 g/cm (5000 g/in) and/or from about 354 g/cm (900 g/in) to about 1181 g/cm (3000 g/in) and/or from about 354 g/cm (900 g/in) to about 984 g/cm (2500 g/in) and/or from about 394 g/cm (1000 g/in) to about 787 g/cm (2000 g/in).

The sanitary tissue products of the present invention may exhibit an initial total wet tensile strength of less than about 78 g/cm (200 g/in) and/or less than about 59 g/cm (150 g/in) and/or less than about 39 g/cm (100 g/in) and/or less than about 29 g/cm (75 g/in).

The sanitary tissue products of the present invention may exhibit an initial total wet tensile strength of greater than about 118 g/cm (300 g/in) and/or greater than about 157 g/cm (400 g/in) and/or greater than about 196 g/cm (500 g/in) and/or greater than about 236 g/cm (600 g/in) and/or greater than about 276 g/cm (700 g/in) and/or greater than about 315 g/cm (800 g/in) and/or greater than about 354 g/cm (900 g/in) and/or greater than about 394 g/cm (1000 g/in) and/or from about 118 g/cm (300 g/in) to about 1968 g/cm (5000 g/in) and/or from about 157 g/cm (400 g/in) to about 1181 g/cm (3000 g/in) and/or from about 196 g/cm (500 g/in) to about 984 g/cm (2500 g/in) and/or from about 196 g/cm (500 g/in) to about 787 g/cm (2000 g/in) and/or from about 196 g/cm (500 g/in) to about 591 g/cm (1500 g/in).

The sanitary tissue products of the present invention may exhibit a density of less than about 0.60 g/cm$^3$ and/or less than about 0.30 g/cm$^3$ and/or less than about 0.20 g/cm$^3$ and/or less than about 0.10 g/cm$^3$ and/or less than about 0.07 g/cm$^3$ and/or less than about 0.05 g/cm$^3$ and/or from about 0.01 g/cm$^3$ to about 0.20 g/cm$^3$ and/or from about 0.02 g/cm$^3$ to about 0.10 g/cm$^3$.

The sanitary tissue products of the present invention may exhibit a total absorptive capacity of according to the Horizontal Full Sheet (HFS) Test Method described herein of greater than about 10 g/g and/or greater than about 12 g/g and/or greater than about 15 g/g and/or from about 15 g/g to about 50 g/g and/or to about 40 g/g and/or to about 30 g/g.

The sanitary tissue products of the present invention may exhibit a Vertical Full Sheet (VFS) value as determined by the Vertical Full Sheet (VFS) Test Method described herein of greater than about 5 g/g and/or greater than about 7 g/g and/or greater than about 9 g/g and/or from about 9 g/g to about 30 g/g and/or to about 25 g/g and/or to about 20 g/g and/or to about 17 g/g.

The sanitary tissue products of the present invention may be in the form of sanitary tissue product rolls. Such sanitary tissue product rolls may comprise a plurality of connected, but perforated sheets of fibrous structure, that are separably dispensable from adjacent sheets.

The sanitary tissue products of the present invention may comprises additives such as softening agents, temporary wet strength agents, permanent wet strength agents, bulk softening agents, lotions, silicones, wetting agents, latexes, patterned latexes and other types of additives suitable for inclusion in and/or on sanitary tissue products.

"Hydroxyl polymer" as used herein includes any hydroxyl-containing polymer that can be incorporated into a fibrous structure of the present invention, such as into a fibrous structure in the form of a fibrous element. In one example, the hydroxyl polymer of the present invention includes greater than 10% and/or greater than 20% and/or greater than 25% by weight hydroxyl moieties.

"Biodegradable" as used herein means, with respect to a material, such as a fibrous element as a whole and/or a polymer within a fibrous element, that the fibrous element and/or polymer is capable of undergoing and/or does undergo physical, chemical, thermal and/or biological degradation in a municipal solid waste composting facility such that at least 5% and/or at least 7% and/or at least 10% of the original fibrous element and/or polymer is converted into carbon dioxide after 30 days as measured according to the OECD (1992) Guideline for the Testing of Chemicals 301B; Ready Biodegradability—$CO_2$ Evolution (Modified Sturm Test) Test incorporated herein by reference.

"Non-biodegradable" as used herein means, with respect to a material, such as a fibrous element as a whole and/or a polymer within a fibrous element, that the fibrous element and/or polymer is not capable of undergoing physical, chemical, thermal and/or biological degradation in a municipal solid waste composting facility such that at least 5% of the original fibrous element and/or polymer is converted into carbon dioxide after 30 days as measured according to the OECD (1992) Guideline for the Testing of Chemicals 301B; Ready Biodegradability—$CO_2$ Evolution (Modified Sturm Test) Test incorporated herein by reference.

"Non-thermoplastic" as used herein means, with respect to a material, such as a fibrous element as a whole and/or a polymer within a fibrous element, that the fibrous element and/or polymer exhibits no melting point and/or softening point, which allows it to flow under pressure, in the absence of a plasticizer, such as water, glycerin, sorbitol, urea and the like.

"Non-thermoplastic, biodegradable fibrous element" as used herein means a fibrous element that exhibits the properties of being biodegradable and non-thermoplastic as defined above.

"Non-thermoplastic, non-biodegradable fibrous element" as used herein means a fibrous element that exhibits the properties of being non-biodegradable and non-thermoplastic as defined above.

"Thermoplastic" as used herein means, with respect to a material, such as a fibrous element as a whole and/or a polymer within a fibrous element, that the fibrous element and/or polymer exhibits a melting point and/or softening point at a certain temperature, which allows it to flow under pressure, in the absence of a plasticizer "Thermoplastic, biodegradable fibrous element" as used herein means a fibrous element that exhibits the properties of being biodegradable and thermoplastic as defined above.

"Thermoplastic, non-biodegradable fibrous element" as used herein means a fibrous element that exhibits the properties of being non-biodegradable and thermoplastic as defined above.

"Non-cellulose-containing" as used herein means that less than 5% and/or less than 3% and/or less than 1% and/or less than 0.1% and/or 0% by weight of cellulose polymer, cellulose derivative polymer and/or cellulose copolymer is present in fibrous element. In one example, "non-cellulose-containing" means that less than 5% and/or less than 3% and/or less than 1% and/or less than 0.1% and/or 0% by weight of cellulose polymer is present in fibrous element.

"Different from" as used herein means, with respect to a material, such as a fibrous element as a whole and/or a polymer within a fibrous element, that one material, such as a fibrous element and/or polymer, is chemically, physically and/or structurally different from another material, such as a fibrous element and/or polymer. For example, a polymer in the form of a filament is different from the same polymer in the form of a fiber. Likewise, a starch polymer is different from a cellulose polymer. However, different molecular weights of the same material, such as different molecular weights of a starch, are not different materials from one another for purposes of the present invention.

"Random mixture of polymers" as used herein means that two or more different polymers are randomly combined to form a fibrous element. Accordingly, two or more different polymers that are orderly combined to form a fibrous element, such as a core and sheath bicomponent fibrous element, is not a random mixture of different polymers for purposes of the present invention.

"Associate," "Associated," "Association," and/or "Associating" as used herein with respect to fibrous elements means combining, either in direct contact or in indirect contact, fibrous elements such that a fibrous structure is formed. In one example, the associated fibrous elements may be bonded together for example by adhesives and/or thermal bonds. In another example, the fibrous elements may be associated with one another by being deposited onto the same fibrous structure making belt and/or patterned belt.

"Weight average molecular weight" as used herein means the weight average molecular weight as determined using gel permeation chromatography according to the protocol found in Colloids and Surfaces A. Physico Chemical & Engineering Aspects, Vol. 162, 2000, pg. 107-121.

"Length" as used herein, with respect to a fibrous element, means the length along the longest axis of the fibrous element from one terminus to the other terminus. If a fibrous element has a kink, curl or curves in it, then the length is the length along the entire path of the fibrous element. If a portion of the fibrous element is bonded to another fibrous element such that both termini are not discernible, such as a thermal bond site, then the an effective terminus of such a fibrous element is the point of the fibrous element immediately prior to the bond site.

"Average Diameter" as used herein, with respect to a fibrous element, is measured according to the Average Diameter Test Method described herein. In one example, a fibrous element of the present invention exhibits an average diameter of less than 25 μm and/or less than 20 μm and/or less than 15 μm and/or less than 10 μm and/or less than 6 μm and/or greater than 1 μm and/or greater than 3 μm.

"Length to Average Diameter Ratio" as used herein is the Length in millimeters divided by the Average Diameter in millimeters of a fibrous element. The Length to Average Diameter Ratio is unitless. In one example, the Length to Average Diameter Ratio is greater than 2000 and/or greater than 3000 and/or greater than 3500 and/or greater than 4000.

"Effective Diameter" as used herein is the product of the following mathematical formula: 0.01128×Square Root of (Decitex of a fibrous element/Material density ($g/cm^3$) of the fibrous element).

"Decitex" as used herein means the weight in grams of a 10,000 meter length of a fibrous element. A fibrous element's decitex can be determined either by direct weight measurement or by indirect means such as calculations based on the cross-sectional area of the fibrous element and the material density of the fibrous element.

"Material density" as used herein means the quantity of fibrous element per unit volume. Material density is expressed in $g/cm^3$.

"Length to Effective Diameter Ratio" as used herein is the Length in millimeters divided by the Effective Diameter in millimeters of a fibrous element. The Length to Effective Diameter Ratio is unitless. In one example, the Length to Effective Diameter Ratio is greater than 2000 and/or greater than 3000 and/or greater than 3500 and/or greater than 4000.

"Basis Weight" as used herein is the weight per unit area of a sample reported in lbs/3000 $ft^2$ or $g/m^2$.

"Water-soluble" as used herein means a material that is miscible in water. In other words, a material that is capable of forming a stable (stable for greater than 5 minutes) homogeneous solution with water at ambient conditions.

"Machine Direction" or "MD" as used herein means the direction parallel to the flow of the fibrous structure through the papermaking machine and/or product manufacturing equipment.

"Cross Machine Direction" or "CD" as used herein means the direction perpendicular to the machine direction in the same plane of the fibrous structure and/or paper product comprising the fibrous structure.

"Ply" or "Plies" as used herein means an individual fibrous structure optionally to be disposed in a substantially contiguous, face-to-face relationship with other plies, forming a multiple ply fibrous structure. It is also contemplated that a single fibrous structure can effectively form two "plies" or multiple "plies", for example, by being folded on itself.

As used herein, the articles "a" and "an" when used herein, for example, "an anionic surfactant" or "a fiber" is understood to mean one or more of the material that is claimed or described.

All percentages and ratios are calculated by weight unless otherwise indicated. All percentages and ratios are calculated based on the total composition unless otherwise indicated.

Unless otherwise noted, all component or composition levels are in reference to the active level of that component or composition, and are exclusive of impurities, for example, residual solvents or by-products, which may be present in commercially available sources.

Polymers

The fibrous elements, such as filaments and/or fibers, of the present invention that associate to form the fibrous structures of the present invention may contain various types of polymers such as hydroxyl polymers, non-thermoplastic polymers, thermoplastic polymers, biodegradable polymers, non-biodegradable polymers and mixtures thereof.

a. Hydroxyl Polymers—Nonlimiting examples of hydroxyl polymers in accordance with the present invention include polyols, such as polyvinyl alcohol, polyvinyl alcohol derivatives, polyvinyl alcohol copolymers, starch, starch derivatives, starch copolymers, chitosan, chitosan derivatives, chitosan copolymers, cellulose, cellulose derivatives such as cellulose ether and ester derivatives, cellulose copolymers, hemicellulose, hemicellulose derivatives, hemicellulose copolymers, gums, arabinans, galactans, proteins and various other polysaccharides and mixtures thereof.

In one example, a hydroxyl polymer of the present invention is a polysaccharide.

In another example, a hydroxyl polymer of the present invention is a non-thermoplastic polymer.

The hydroxyl polymer may have a weight average molecular weight of from about 10,000 g/mol to about 40,000,000 g/mol and/or greater than about 100,000 g/mol and/or greater than about 1,000,000 g/mol and/or greater than about 3,000,000 g/mol and/or greater than about 3,000,000 g/mol to about 40,000,000 g/mol. Higher and lower molecular weight hydroxyl polymers may be used in combination with hydroxyl polymers having a certain desired weight average molecular weight.

Well known modifications of hydroxyl polymers, such as natural starches, include chemical modifications and/or enzymatic modifications. For example, natural starch can be acid-thinned, hydroxy-ethylated, hydroxy-propylated, and/or oxidized. In addition, the hydroxyl polymer may comprise dent corn starch hydroxyl polymer.

Polyvinyl alcohols herein can be grafted with other monomers to modify its properties. A wide range of monomers has been successfully grafted to polyvinyl alcohol. Nonlimiting examples of such monomers include vinyl acetate, styrene, acrylamide, acrylic acid, 2-hydroxyethyl methacrylate, acrylonitrile, 1,3-butadiene, methyl methacrylate, methacrylic acid, vinylidene chloride, vinyl chloride, vinyl amine and a variety of acrylate esters.

"Polysaccharides" as used herein means natural polysaccharides and polysaccharide derivatives and/or modified polysaccharides. Suitable polysaccharides include, but are not limited to, starches, starch derivatives, chitosan, chitosan derivatives, cellulose, cellulose derivatives, hemicellulose, hemicellulose derivatives, gums, arabinans, galactans and mixtures thereof. The polysaccharide may exhibit a weight average molecular weight of from about 10,000 to about 40,000,000 g/mol and/or greater than about 100,000 and/or greater than about 1,000,000 and/or greater than about 3,000,000 and/or greater than about 3,000,000 to about 40,000,000.

Non-cellulose and/or non-cellulose derivative and/or non-cellulose copolymer hydroxyl polymers, such as non-cellulose polysaccharides may be selected from the group consisting of: starches, starch derivatives, chitosan, chitosan derivatives, hemicellulose, hemicellulose derivatives, gums, arabinans, galactans and mixtures thereof.

b. Thermoplastic Polymers—Nonlimiting examples of suitable thermoplastic polymers include polyolefins, polyesters, copolymers thereof, and mixtures thereof. Nonlimiting examples of polyolefins include polypropylene, polyethylene and mixtures thereof. A nonlimiting example of a polyester includes polyethylene terephthalate.

The thermoplastic polymers may comprise a non-biodegradable polymer, examples of such include polypropylene, polyethylene and certain polyesters; and the thermoplastic polymers may comprise a biodegradable polymer, examples of such include polylactic acid, polyhydroxyalkanoate, polycaprolactone, polyesteramides and certain polyesters.

The thermoplastic polymers of the present invention may be hydrophilic or hydrophobic. The thermoplastic polymers may be surface treated and/or internally treated to change the inherent hydrophilic or hydrophobic properties of the thermoplastic polymer.

Any suitable weight average molecular weight for the thermoplastic polymers may be used. For example, the weight average molecular weight for a thermoplastic polymer in accordance with the present invention is greater than about 10,000 g/mol and/or greater than about 40,000 g/mol and/or greater than about 50,000 g/mol and/or less than about 500,000 g/mol and/or less than about 400,000 g/mol and/or less than about 200,000 g/mol.

c. Biodegradable Polymers—Nonlimiting examples of suitable biodegradable polymers include hydroxyl polymers described above, polylactic acid, polyhydroxyalkanoate, polycarprolactone, polyesteramides and other biodegradable polymers known in the art, and mixtures thereof.

Any suitable weight average molecular weight for the biodegradable thermoplastic polymers may be used. For example, the weight average molecular weight for a biodegradable thermoplastic polymer in accordance with the present invention can be from about 10,000 g/mol to about 40,000,000 g/mol and/or greater than about 100,000 g/mol and/or greater than about 1,000,000 g/mol and/or greater than about 3,000,000 g/mol and/or greater than about 3,000,000 g/mol to about 40,000,000 g/mol.

d. Non-biodegradable Polymers—Nonlimiting examples of suitable non-biodegradable polymers include polypropylene, polyethylene, polyesters, copolymers thereof, other non-biodegradable polymers known in the art, and mixtures thereof.

Any suitable weight average molecular weight for the non-biodegradable thermoplastic polymers may be used. For example, the weight average molecular weight for a non-biodegradable thermoplastic polymer in accordance with the present invention is greater than about 10,000 g/mol and/or greater than about 40,000 g/mol and/or greater than about 50,000 g/mol and/or less than about 500,000 g/mol and/or less than about 400,000 g/mol and/or less than about 200,000 g/mol.

Fibrous Structures

Figure 2:
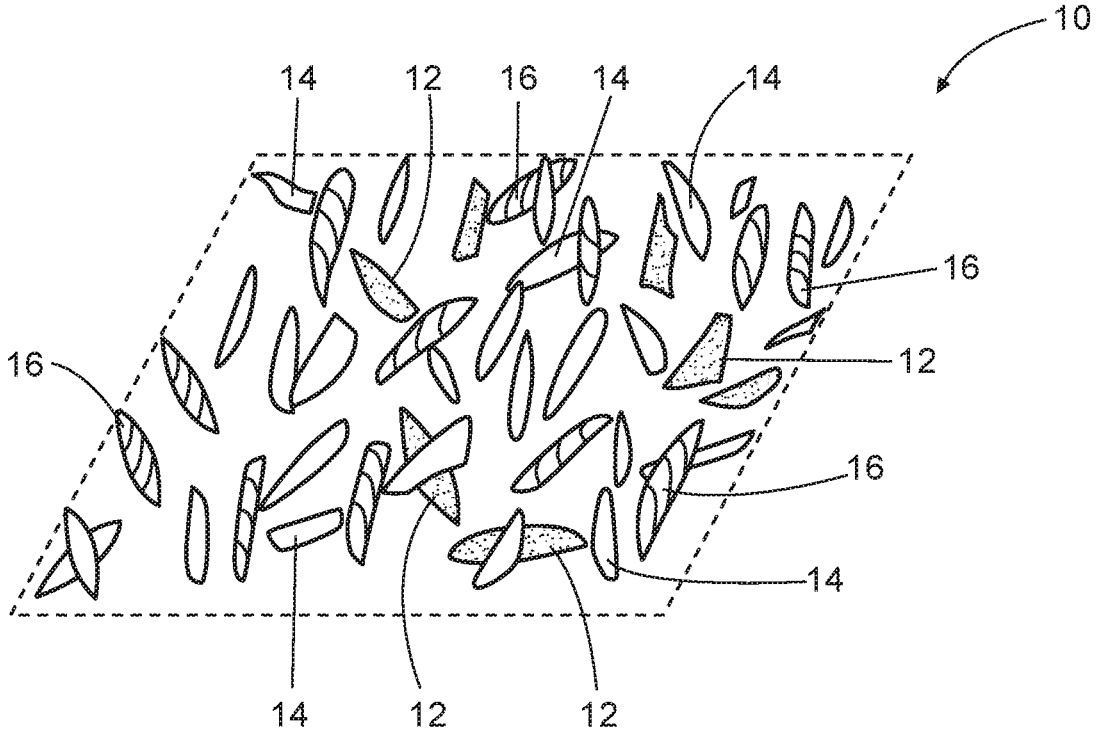
FIG. 2 is a schematic representation of another example of a fibrous structure according to the present invention.
Figure 3:
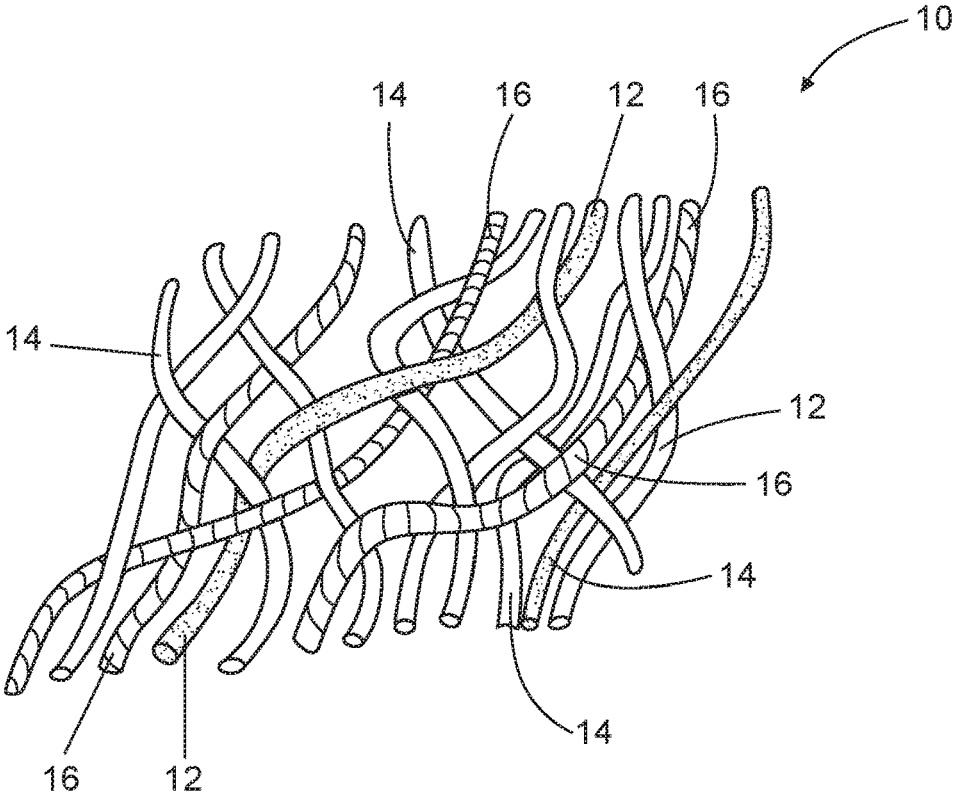
FIG. 3 is a schematic representation of another example of a fibrous structure according to the present invention.

As shown in FIGS. 1-3, the fibrous structure 10 of the present invention may comprise one or more first fibrous elements 12, one or more second fibrous elements 14 and one or more third fibrous elements 16 wherein the first, second and third fibrous elements 12, 14, 16 are all different from each other.

The first fibrous element 12 may comprise one or more of the following types of fibrous elements: 1) a non-thermoplastic, fibrous element having a length to average diameter ratio of greater than 2000 and/or a length to effective diameter ratio of greater than 2000; 2) a fibrous element comprising a random mixture of polymers wherein at least one of the polymers is a biodegradable polymer, wherein the fibrous element exhibits a length to average diameter ratio of greater than 2000 and/or a length to effective diameter ratio of greater than 2000; 3) a filament comprising a random mixture of polymers wherein at least one of the polymers is a biodegradable polymer; and 4) a non-thermoplastic filament.

The fibrous structure 10 of the present invention may comprise a mixture of fibers and/or filaments. In one example, the fibrous structure comprises at least one filament and at least one fiber. In another example, the fibrous structure may comprise two different filaments and a fiber. In yet another example, the fibrous structure may comprise two different fibers and a filament. As shown in FIG. 2, the first, second and third fibrous elements 12, 14, 16 may all be fibers. As shown in FIG. 3, the first, second and third fibrous elements 12, 14, 16 may all be filaments.

In one example, the first fibrous element 12 comprises a filament, the second fibrous element 14 comprises a fiber and the third fibrous element 16 comprises a filament.

In another example, the first fibrous element 12 comprises a filament, the second fibrous element 14 comprises a filament and the third fibrous element 16 comprises a fiber.

In yet another example, the first fibrous element 12 comprises a fiber, the second fibrous element 14 comprises a filament and the third fibrous element 16 comprises a filament.

In still yet another example, the first fibrous element 12 comprises a filament, the second fibrous element 14 comprises a fiber and the third fibrous element 16 comprises a fiber.

In even yet another example, the first fibrous element 12 comprises a fiber, the second fibrous element 14 comprises a filament and the third fibrous element 16 comprises a fiber.

In even still yet another example, the first fibrous element 12 comprises a fiber, the second fibrous element 14 comprises a fiber and the third fibrous element 16 comprises a filament.

The fibrous structure 10 of the present invention may comprise a mixture of biodegradable and/or non-biodegradable fibrous elements. In one example, the first, second and third fibrous elements 12, 14, 16 may all be biodegradable. In another example, the first, second and third fibrous elements 12, 14, 16 may all be non-biodegradable.

In one example, the first fibrous element 12 is a biodegradable fibrous element, the second fibrous element 14 is a biodegradable fibrous element and the third fibrous element 16 is a non-biodegradable fibrous element.

In another example, the first fibrous element 12 is a biodegradable fibrous element, the second fibrous element 14 is a non-biodegradable fibrous element and the third fibrous element 16 is a biodegradable fibrous element.

In yet another example, the first fibrous element 12 is a non-biodegradable fibrous element, the second fibrous element 14 is a biodegradable fibrous element and the third fibrous element 16 is a biodegradable fibrous element.

In another example, the first fibrous element 12 is a biodegradable fibrous element, the second fibrous element 14 is a non-biodegradable fibrous element and the third fibrous element 16 is a non-biodegradable fibrous element.

In even another example, the first fibrous element 12 is a non-biodegradable fibrous element, the second fibrous element 14 is a biodegradable fibrous element and the third fibrous element 16 is a non-biodegradable fibrous element.

In still yet another example, the first fibrous element 12 is a non-biodegradable fibrous element, the second fibrous element 14 is a non-biodegradable fibrous element and the third fibrous element 16 is a biodegradable fibrous element.

The fibrous elements of the fibrous structure of the present invention may comprise a biodegradable and/or non-biodegradable polymer.

In one example, the first fibrous element 12 comprises a biodegradable polymer. In another example, the first fibrous element 12 comprises a non-biodegradable polymer. In yet another example, the second fibrous element 14 comprises a biodegradable polymer. In still another example, the second fibrous element 14 comprises a non-biodegradable polymer. In even another example, the third fibrous element 16 comprises a biodegradable polymer. In still yet another example, the third fibrous element 16 comprises a non-biodegradable polymer.

In one example, the first fibrous element 12 comprises a biodegradable polymer. The second fibrous element 14 may comprise a biodegradable polymer. The third fibrous element 16 may comprise a non-biodegradable polymer and/or a biodegradable polymer.

The fibrous structure 10 of the present invention may comprise a mixture of thermoplastic and/or non-thermoplastic fibrous elements. In one example, the first, second and third fibrous elements 12, 14, 16 may all be non-thermoplastic. In another example, the first, second and third fibrous elements 12, 14, 16 may all be thermoplastic.

In one example, the first fibrous element 12 is a non-thermoplastic fibrous element, the second fibrous element 14 is a non-thermoplastic fibrous element and the third fibrous element 16 is a thermoplastic fibrous element.

In another example, the first fibrous element 12 is a non-thermoplastic fibrous element, the second fibrous element 14 is a thermoplastic fibrous element and the third fibrous element 16 is a non-thermoplastic fibrous element.

In yet another example, the first fibrous element 12 is a thermoplastic fibrous element, the second fibrous element 14 is a non-thermoplastic fibrous element and the third fibrous element 16 is a non-thermoplastic fibrous element.

In another example, the first fibrous element 12 is a non-thermoplastic fibrous element, the second fibrous element 14 is a thermoplastic fibrous element and the third fibrous element 16 is a thermoplastic fibrous element.

In even another example, the first fibrous element 12 is a thermoplastic fibrous element, the second fibrous element 14 is a non-thermoplastic fibrous element and the third fibrous element 16 is a thermoplastic fibrous element.

In still yet another example, the first fibrous element 12 is a thermoplastic fibrous element, the second fibrous element 14 is a thermoplastic fibrous element and the third fibrous element 16 is a non-thermoplastic fibrous element.

Each of the first, second and third fibrous elements 12, 14, 16 may comprise a non-thermoplastic polymer and/or a thermoplastic polymer.

In one example, the first fibrous element 12 comprises a non-thermoplastic polymer, the second fibrous element 14 comprises a non-thermoplastic polymer, and the third fibrous element 16 comprises a thermoplastic polymer.

In another example, the first fibrous element 12 comprises a non-thermoplastic polymer, the second fibrous element 14 comprises a non-thermoplastic polymer, and third fibrous element 16 comprises a non-thermoplastic polymer.

The fibrous structure of the present invention may comprise a pulp fiber.

In one example, the fibrous structure of the present invention may comprise a polysaccharide filament, such as a starch filament. In another example, the polysaccharide filament may comprise a non-cellulose polysaccharide.

In another example, the fibrous structure of the present invention may comprise a polysaccharide fiber, such as a cellulosic fiber, for example a pulp fiber, especially a wood pulp fiber.

In yet another example, the fibrous structure of the present invention may comprise a polysaccharide filament, such as a starch filament, and a polysaccharide fiber, such as a wood pulp fiber.

In still another example, the fibrous structure of the present invention may comprise a polysaccharide filament, such as a starch filament, a polysaccharide fiber, such as a wood pulp fiber, and a thermoplastic fiber, such as a polypropylene fiber.

The distribution of the fibrous elements within the fibrous structure of the present invention may be homogeneous or substantially homogeneous or layered.

In one example, the fibrous structure comprises an inner layer of polysaccharide filaments, such as starch filaments, and at least one outer layer comprising a mixture of polysaccharide fibers, such as wood pulp fibers, and thermoplastic fibers, such as polypropylene fibers.

In another example, the fibrous structure comprises an inner layer comprising a mixture of thermoplastic filaments, such as polypropylene filaments, and pulp fibers, and an outer layer comprising polysaccharide filaments, such as starch filaments.

In yet another example, the first fibrous element 12 is chemically different from the second and third fibrous elements 14, 16.

One or more of the fibrous elements may comprise a greater than about 5% and/or greater than about 10% and/or greater than about 25% and/or greater than about 40% and/or greater than about 50% by weight of a water-soluble polymer, such as a starch, and exhibit an initial total wet tensile of greater than about 0.2 MPa and/or greater than 0.5 MPa and/or greater than 0.75 MPa and/or greater than 1.0 MPa and/or less than about 50 MPa and/or less than about 30 MPa and/or less than about 20 MPa.

The fibrous elements may be present in the fibrous structure at any suitable range, such as from 1% to about 98% and/or from about 5% to about 90% and/or from about 10% to about 80% by weight. For example, a fibrous structure may comprise from about 1% to about 98% and/or from about 5% to about 90% and/or from about 10% to about 80% by weight of a first fibrous element 12, from about 1% to about 98% and/or from about 5% to about 90% and/or from about 10% to about 80% by weight of a second fibrous element 14 and from about 1% to about 98% of a third fibrous element.

In one example, a fibrous structure in accordance with the present invention comprises from about 25% to about 80% by weight a second fibrous element 14 and from about 0.5% to about 50% by weight of a third fibrous element and the remaining balance of a first fibrous element 12.

In another example, a fibrous structure in accordance with the present invention comprises greater than 30% to about 80% by weight of a first fibrous element 12, from about 1% to less than 30% by weight of a second fibrous element 14 and from about 0.5% to about 10% by weight of a third fibrous element.

In yet another example, a fibrous structure in accordance with the present invention comprises from about 0.5% to about 10% by weight of a first fibrous element 12, from about 30% to about 80% by weight of a second fibrous element 14 and from about 10% to about 50% of a third fibrous element.

Figure 4:
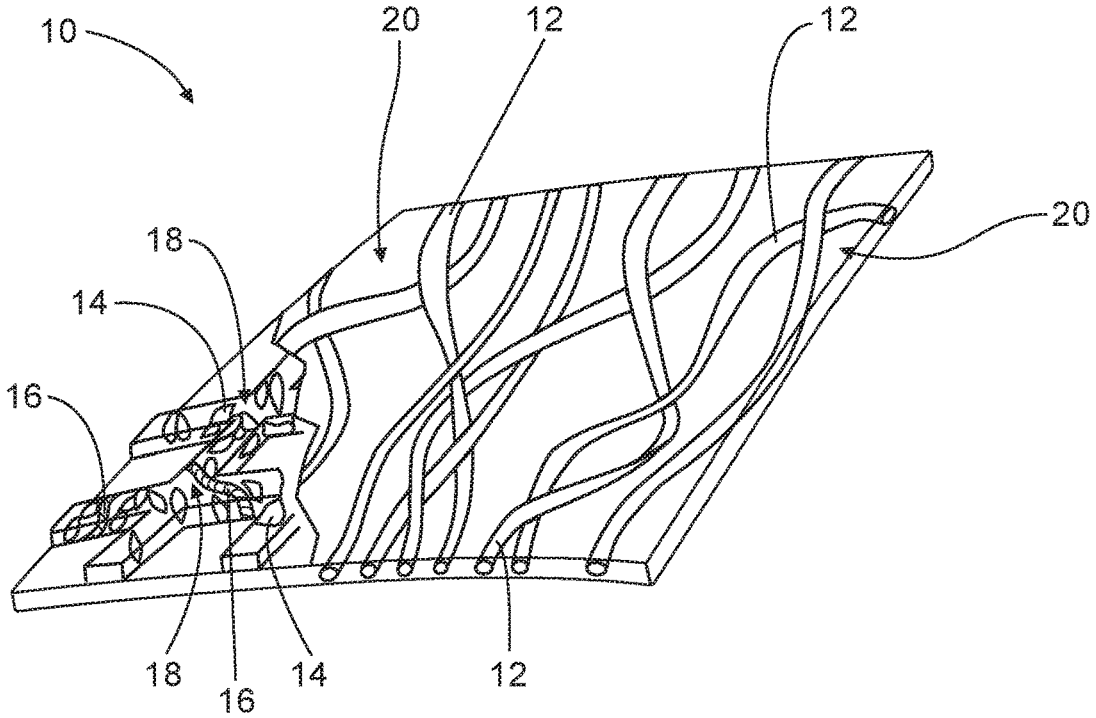
FIG. 4 is a schematic, partially cut-away representation of another example of a fibrous structure according to the present invention.

The fibrous elements may be associated together to form a fibrous structure in any suitable manner. In one example, the fibrous elements may be associated in a pattern such that the fibrous structure exhibits a non-uniform basis weight. For example, as shown in FIG. 4, discrete deposits and/or a discontinuous or continuous network 18, a portion of which is shown in FIG. 4, of a mixture of second and third fibrous elements 14, 16 may be associated, such as by deposition, with a surface of a filament web 20 comprising a plurality of first fibrous elements 12 such that the mixture of second and third fibrous elements 14, 16 results in a fibrous structure 10 comprising a pattern. The pattern may be random or non-random and/or repeating or non-repeating.

Methods for Making Fibrous Structures

Figure 5:
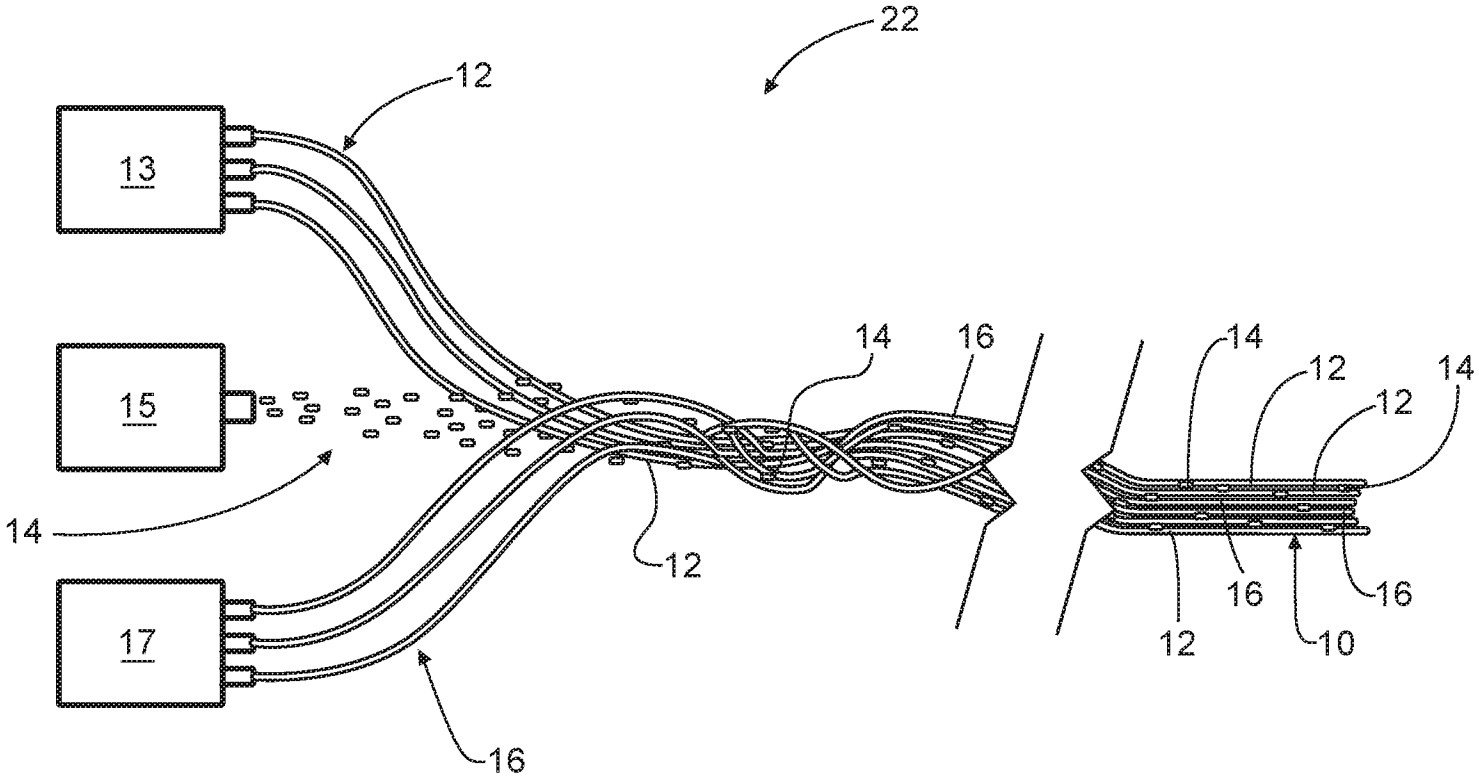
FIG. 5 is a schematic representation of an example of a method for making a fibrous structure according to the present invention.

FIG. 5 illustrates one example of a method for making fibrous structures of the present invention. As shown in FIG. 5, the method 22 for making a fibrous structure 10 comprises the step of associating a plurality of first fibrous elements 12 produced from a first source 13, such as a meltblow die, a plurality of second fibrous elements 14 different from the first fibrous elements 12 produced from a second source 15, such as a hammermill and former for delivering pulp fibers, and a plurality of third fibrous elements 16 different from the first and second fibrous elements 12, 14 produced from a third source 17, such as a meltblow die. Any of the fibrous elements 12, 14, 16 may be in the form of a fibrous structure (web) or as individual fibrous elements.

After forming the fibrous structure 10, the fibrous structure 10 may be subjected to various post-processing operations such as thermal bonding, embossing, surface treating, perforating, tuft generating process, folding, printing and other post-processing operations known to those skilled in the art.

Figure 6:
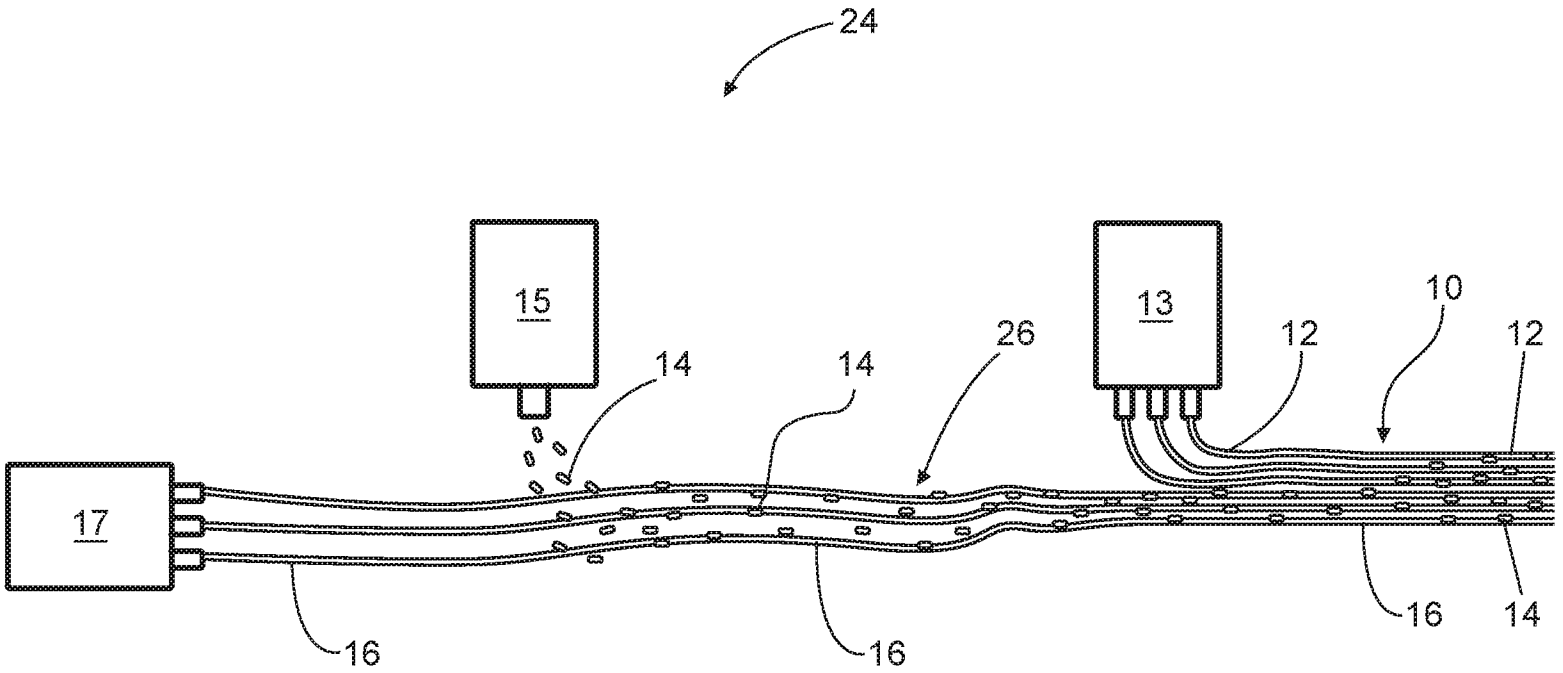
FIG. 6 is a schematic representation of an example of a method for making a fibrous structure according to the present invention.

As shown in FIG. 6, a fibrous structure of the present invention may be made by a method 24 comprising the steps of associating a plurality of second and third fibrous elements 14, 16 different from one another produced from a second and third source 15, 17, respectively, to form a web 26; and associating a plurality of first fibrous elements 12 different from the second and third fibrous elements 14, 16 produced from a first source 13 with the web 26 such that a fibrous structure 10 according to the present invention is formed.

Figure 7:
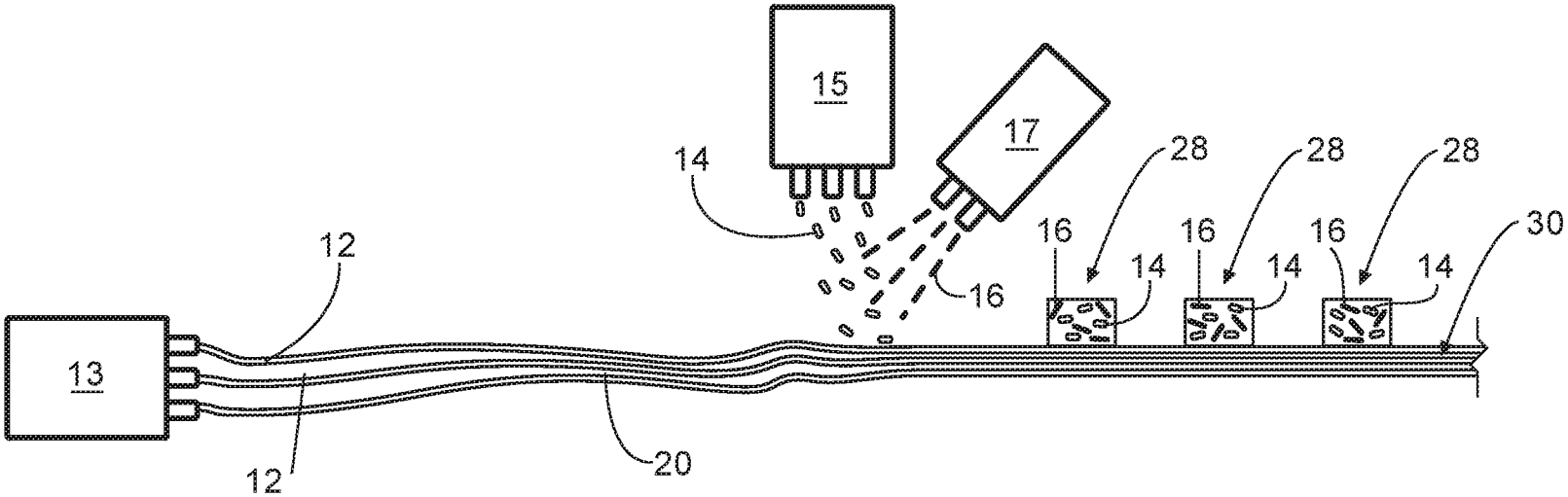
FIG. 7 is a schematic representation of an example of a method for making a fibrous structure according to the present invention.

In another example as shown in FIG. 7, a fibrous structure of the present invention may be made by first forming a web

20 comprising a plurality of fibrous elements, in this case, a plurality of first fibrous elements 12 (e.g., filaments) produced from a source 13, such as a meltblow die. Next, a mixture of fibrous elements, in this case a plurality of second and third fibrous elements 14, 16 (e.g., fibers), from sources 15 and 17, are associated as discrete deposits 28 on a surface 30 of the web 20 to produce a fibrous structure in accordance with the present invention.

Nonlimiting Examples of Fibrous Structures a. Fibrous Structure Comprising Starch Filaments/Wood Pulp Fibers/Thermoplastic Fibers A melt composition comprising 10% Mowiol 10-98 commercially available from Kuraray Co. (polyvinyl alcohol), 39.25% Ethylex 2035 commercially available from Tate & Lyle (starch derivative), 39.25% Eclipse G commercially available from Tate & Lyle (starch), 0.7% C-12 quaternary ammonium compound commercially available from Degussa, 6.9% Urea glyoxal adduct crosslinking agent, 3.9% Ammonium Chloride available from Aldrich is prepared. The melt composition is cooked and extruded from a co-rotating twin screw extruder at approx 50% solids (50% $H_2O$).

The melt composition is then pumped to a meltblown spinnerette and attenuated with a 160° F. saturated air stream to form non-thermoplastic, non-cellulose-containing, biodegradable filaments. The filaments are then dried by convection drying before being deposited on a forming belt to form a filament web. These meltblown filaments are essentially continuous filaments.

Wood pulp fibers (non-thermoplastic, biodegradable fibers), Southern Softwood Kraft available as roll comminution pulp, is disintegrated by a hammermill and conveyed to an airlaid former via a blower.

Thermoplastic fibers (non-biodegradable, polypropylene/polyethylene bicomponent fibers) are metered into the wood pulp fiber stream prior to the same blower described above. This mixed fiber stream is then laid down on a surface of the previously formed filament web. The airlaid forming system used in this example is manufactured by Danweb of Aarhus, Denmark. The resulting fibrous structure is then thermally bonded with a patterned bonding roll to produce a fibrous structure according to the present invention.

b. Fibrous Structures Comprising Starch Filaments, Wood Pulp Fibers/Thermoplastic Fibers A fibrous structure is made according to Example a. above, except that polylactic acid fibers (thermoplastic, biodegradable fibers) are used in place of polypropylene/polyethylene bicomponent fibers (thermoplastic, non-biodegradable fibers).

c. Fibrous Structures Comprising Starch Filaments/Wood Pulp Fibers/Thermoplastic Filaments A fibrous structure is made according to Example a. above, except that polypropylene/polyethylene bicomponent thermoplastic fibers (thermoplastic, non-biodegradable fibers) are replaced with polypropylene thermoplastic filaments (thermoplastic, non-biodegradable filaments). The polypropylene thermoplastic filaments are meltblown and/or spunbonded and combined with wood pulp fibers to form a mixture of polypropylene filaments and wood pulp fibers. The mixture of polypropylene filaments and wood pulp fibers are associated with the starch filament web to form a fibrous structure. The resulting fibrous structure is then thermally bonded with a patterned bonding roll to produce a fibrous structure according to the present invention.

d. Fibrous Structures Comprising Starch Filaments/Starch Fibers/Thermoplastic Fibers A fibrous structure is made according to Example a. above, except that the wood pulp fibers (non-thermoplastic, biodegradable fibers) are replaced with starch fibers (non-cellulose-containing, non-thermoplastic, biodegradable fibers).

e. Fibrous Structures Comprising Polyvinyl Alcohol Filaments/Wood Pulp Fibers/Thermoplastic Fibers A fibrous structure is made according to Example a. above, except that the non-cellulose-containing, non-thermoplastic, biodegradable filaments are replaced with polyvinyl alcohol filaments (non-cellulose-containing, non-thermoplastic, biodegradable filaments).

f. Fibrous Structures Comprising Starch Filaments/Cellulose Filaments/Thermoplastic Filaments A fibrous structure is made according to Example c. above, except that the wood pulp fibers (non-thermoplastic, biodegradable fibers) have been replaced with cellulose filaments (non-thermoplastic, biodegradable filaments), for example a pre-formed rayon web. The non-cellulose-containing, non-thermoplastic, biodegradable filaments can be deposited on the cellulose filament web and then the thermoplastic filaments (polypropylene filaments) can be deposited on the non-cellulose-containing, non-thermoplastic, biodegradable filaments.

g. Fibrous Structures Comprising Starch Fibers/Wood Pulp Fibers/Thermoplastic Fibers A fibrous structure is made according to Example a. above, except that the non-cellulose-containing, non-thermoplastic, biodegradable filaments are replaced with non-cellulose-containing, non-thermoplastic, biodegradable fibers. Wood pulp is disintegrated with a hammermill to produce wood pulp fibers (non-thermoplastic, biodegradable fibers). The wood pulp fibers are conveyed to an airlaid former via a blower. A mixture of non-cellulose-containing, non-thermoplastic, biodegradable fibers and thermoplastic fibers (polypropylene/polyethylene bicomponent fibers) are metered into the wood pulp fiber stream prior to the same blower described above. This mixed fiber stream is deposited on a forming belt to produce a fibrous structure. The resulting fibrous structure is then thermally bonded with a patterned bonding roll to produce a fibrous structure according to the present invention.

Test Methods

Unless otherwise specified, all tests described herein including those described under the Definitions section and the following test methods are conducted on samples that have been conditioned in a conditioned room at a temperature of 73° F.±4° F. (about 23° C.±2.2° C.) and a relative humidity of 50%±10% for 2 hours prior to the test. All tests are conducted in such conditioned room.

Basis Weight Test Method

Basis weight of a fibrous structure sample is measured by preparing five samples of a certain area ($m^2$) and weighing each sample of the fibrous structure on a top loading balance with a minimum resolution of 0.01 g. The top loading balance is protected from air drafts and other disturbances using a draft shield. Weights are recorded when the readings on the top loading balance become constant. The average weight (g) of the samples is calculated and the average area ($m^2$) is calculated. The basis weight ($g/m^2$) is calculated by dividing the average weight (g) by the average area ($m^2$) of the five samples.

Horizontal Full Sheet (HFS) Test Method

The Horizontal Full Sheet (HFS) test method determines the amount of distilled water absorbed and retained by a fibrous structure of the present invention. This method is performed by first weighing a sample of the fibrous structure to be tested (referred to herein as the "dry weight of the sample"), then thoroughly wetting the sample, draining the wetted sample in a horizontal position and then reweighing (referred to herein as "wet weight of the sample"). The absorptive capacity of the sample is then computed as the amount of water retained in units of grams of water absorbed by the sample. When evaluating different fibrous structure samples, the same size of fibrous structure is used for all samples tested.

The apparatus for determining the HFS capacity of fibrous structures comprises the following:

1) An electronic balance with a sensitivity of at least ±0.01 grams and a minimum capacity of 1200 grams. The balance should be positioned on a balance table and slab to minimize the vibration effects of floor/benchtop weighing. The balance should also have a special balance pan to be able to handle the size of the sample tested (i.e.; a fibrous structure sample of about 11 in. (27.9 cm) by 11 in. (27.9 cm)). The balance pan can be made out of a variety of materials. Plexiglass is a common material used.

Figure 8:
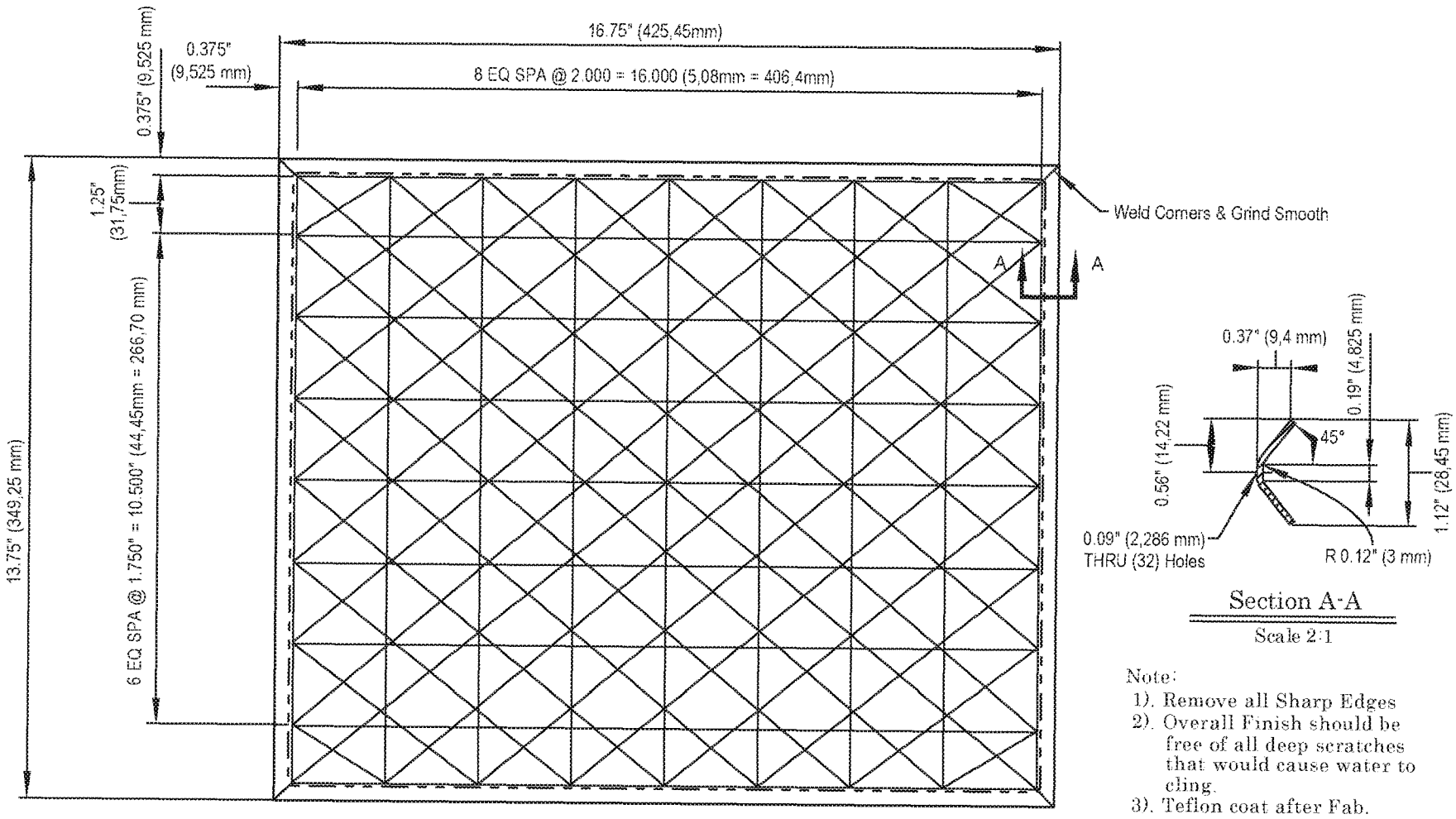
FIG. 8 is a diagram of a support rack utilized in the HFS and VFS Test Methods described herein.
Figure 9:
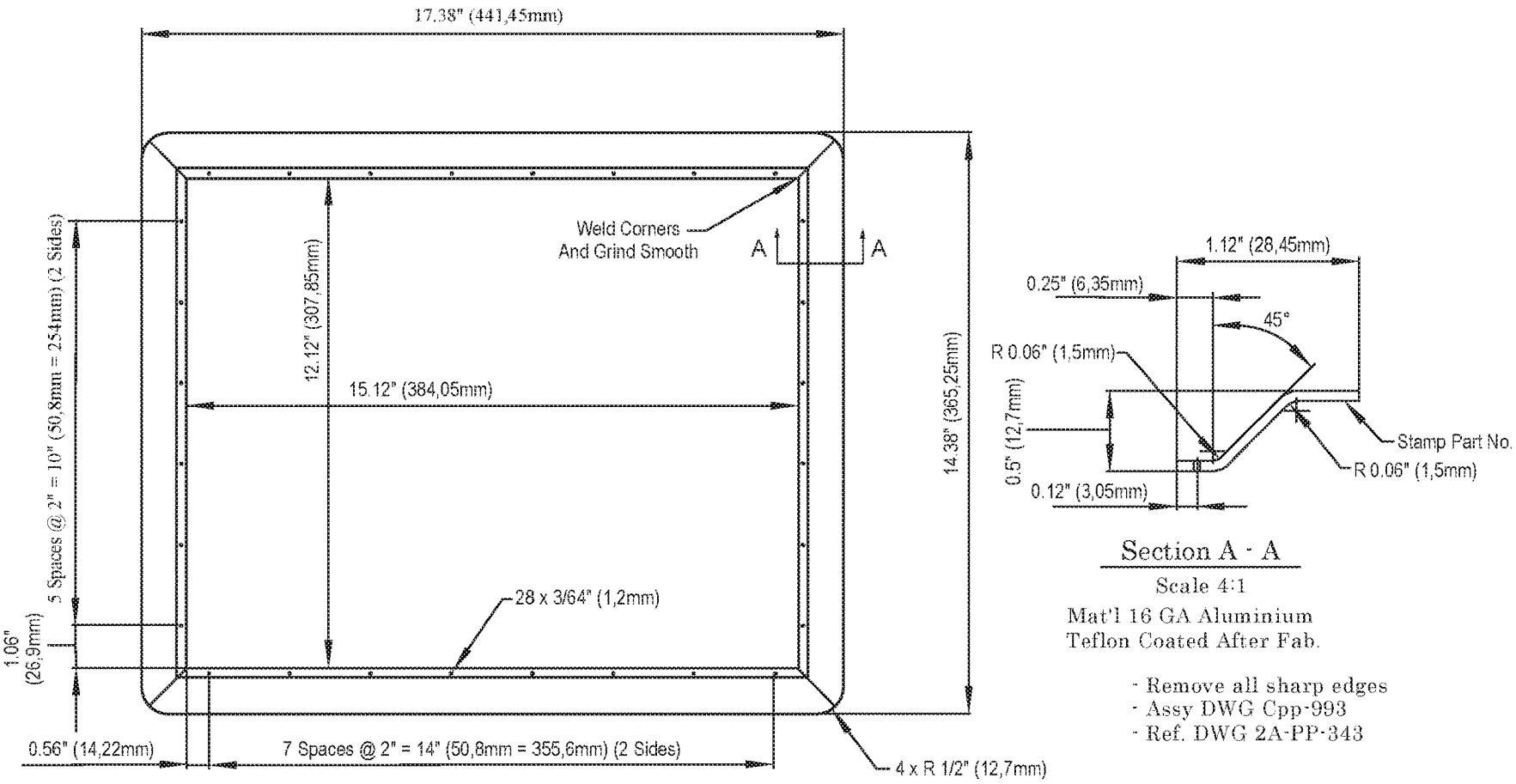
FIG. 9 is a diagram of a support rack cover utilized in the HFS and VFS Test Methods described herein.

2) A sample support rack (FIG. 8) and sample support rack cover (FIG. 9) is also required. Both the rack and cover are comprised of a lightweight metal frame, strung with 0.012 in. (0.305 cm) diameter monofilament so as to form a grid as shown in FIG. 8. The size of the support rack and cover is such that the sample size can be conveniently placed between the two.

The HFS test is performed in an environment maintained at 23±1° C. and 50±2% relative humidity. A water reservoir or tub is filled with distilled water at 23±1° C. to a depth of 3 inches (7.6 cm).

Eight samples of a fibrous structure to be tested are carefully weighed on the balance to the nearest 0.01 grams. The dry weight of each sample is reported to the nearest 0.01 grams. The empty sample support rack is placed on the balance with the special balance pan described above. The balance is then zeroed (tared). One sample is carefully placed on the sample support rack. The support rack cover is placed on top of the support rack. The sample (now sandwiched between the rack and cover) is submerged in the water reservoir. After the sample is submerged for 60 seconds, the sample support rack and cover are gently raised out of the reservoir.

The sample, support rack and cover are allowed to drain horizontally for 120±5 seconds, taking care not to excessively shake or vibrate the sample. While the sample is draining, the rack cover is carefully removed and all excess water is wiped from the support rack. The wet sample and the support rack are weighed on the previously tared balance. The weight is recorded to the nearest 0.01 g. This is the wet weight of the sample.

The gram per fibrous structure sample absorptive capacity of the sample is defined as (wet weight of the sample−dry weight of the sample). The horizontal absorbent capacity (HAC) is defined as: absorbent capacity=(wet weight of the sample−dry weight of the sample)/(dry weight of the sample) and has a unit of gram/gram.

Vertical Full Sheet (VFS) Test Method

The Vertical Full Sheet (VFS) test method determines the amount of distilled water absorbed and retained by a fibrous structure of the present invention. This method is performed by first weighing a sample of the fibrous structure to be tested (referred to herein as the "dry weight of the sample"), then thoroughly wetting the sample, draining the wetted sample in a vertical position and then reweighing (referred to herein as "wet weight of the sample"). The absorptive capacity of the sample is then computed as the amount of water retained in units of grams of water absorbed by the sample. When evaluating different fibrous structure samples, the same size of fibrous structure is used for all samples tested.

The apparatus for determining the VFS capacity of fibrous structures comprises the following:

1) An electronic balance with a sensitivity of at least ±0.01 grams and a minimum capacity of 1200 grams. The balance should be positioned on a balance table and slab to minimize the vibration effects of floor/benchtop weighing. The balance should also have a special balance pan to be able to handle the size of the sample tested (i.e.; a fibrous structure sample of about 11 in. (27.9 cm) by 11 in. (27.9 cm)). The balance pan can be made out of a variety of materials. Plexiglass is a common material used.

2) A sample support rack (FIG. 8) and sample support rack cover (FIG. 9) is also required. Both the rack and cover are comprised of a lightweight metal frame, strung with 0.012 in. (0.305 cm) diameter monofilament so as to form a grid as shown in FIG. 8. The size of the support rack and cover is such that the sample size can be conveniently placed between the two.

The VFS test is performed in an environment maintained at 23±1° C. and 50±2% relative humidity. A water reservoir or tub is filled with distilled water at 23±1° C. to a depth of 3 inches (7.6 cm).

Eight 19.05 cm (7.5 inch)×19.05 cm (7.5 inch) to 27.94 cm (11 inch)×27.94 cm (11 inch) samples of a fibrous structure to be tested are carefully weighed on the balance to the nearest 0.01 grams. The dry weight of each sample is reported to the nearest 0.01 grams. The empty sample support rack is placed on the balance with the special balance pan described above. The balance is then zeroed (tared). One sample is carefully placed on the sample support rack. The support rack cover is placed on top of the support rack. The sample (now sandwiched between the rack and cover) is submerged in the water reservoir. After the sample is submerged for 60 seconds, the sample support rack and cover are gently raised out of the reservoir.

The sample, support rack and cover are allowed to drain vertically for 60±5 seconds, taking care not to excessively shake or vibrate the sample. While the sample is draining, the rack cover is carefully removed and all excess water is wiped from the support rack. The wet sample and the support rack are weighed on the previously tared balance. The weight is recorded to the nearest 0.01 g. This is the wet weight of the sample.

The procedure is repeated for with another sample of the fibrous structure, however, the sample is positioned on the support rack such that the sample is rotated 90° compared to the position of the first sample on the support rack.

The gram per fibrous structure sample absorptive capacity of the sample is defined as (wet weight of the sample−dry weight of the sample). The calculated VFS is the average of the absorptive capacities of the two samples of the fibrous structure.

Average Diameter Test Method

A fibrous structure comprising fibrous elements is cut into a rectangular shape, approximately 20 mm by 35 mm. The sample is then coated using a SEM sputter coater (EMS Inc, PA, USA) with gold so as to make the fibrous elements relatively opaque. Typical coating thickness is between 50 and 250 nm. The sample is then mounted between two standard microscope slides and compressed together using small binder clips. The sample is imaged using a 10× objective on an Olympus BHS microscope with the microscope light-collimating lens moved as far from the objective lens as possible Images are captured using a Nikon D1 digital camera. A Glass microscope micrometer is used to calibrate the spatial distances of the images. The approximate resolution of the images is 1 μm/pixel. Images will typically show a distinct bimodal distribution in the intensity histogram corresponding to the fibrous elements and the background. Camera adjustments or different basis weights are used to achieve an acceptable bimodal distribution. Typically 10 images per sample are taken and the image analysis results averaged.

The images are analyzed in a similar manner to that described by B. Pourdeyhimi, R. and R. Dent in "Measuring fiber diameter distribution in nonwovens" (Textile Res. J. 69(4) 233-236, 1999). Digital images are analyzed by computer using the MATLAB (Version. 6.3) and the MATLAB Image Processing Tool Box (Version 3). The image is first converted into a grayscale. The image is then binarized into black and white pixels using a threshold value that minimizes the intraclass variance of the thresholded black and white pixels. Once the image has been binarized, the image is skeltonized to locate the center of each fibrous element in the image. The distance transform of the binarized image is also computed. The scalar product of the skeltonized image and the distance map provides an image whose pixel intensity is either zero or the radius of the fibrous element at that location. Pixels within one radius of the junction between two overlapping fibrous elements are not counted if the distance they represent is smaller than the radius of the junction. The remaining pixels are then used to compute a length-weighted histogram of fibrous elements diameters contained in the image.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

All documents cited in the Detailed Description of the Invention are, in relevant part, incorporated herein by reference; the citation of any document is not to be construed as an admission that it is prior art with respect to the present invention. To the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A non-wet-laid layered fibrous structure comprising at least three layers, wherein the fibrous structure comprises:

a. a first layer comprising a non-thermoplastic first fibrous element comprising a hydroxyl polymer selected from the group consisting of: polyvinyl alcohol, polyvinyl alcohol derivatives, and mixtures thereof, wherein the first fibrous element exhibits a length of 10.16 cm or greater and a length to average diameter ratio of greater than 2000, wherein the first fibrous element is a first monocomponent filament;

b. a second fibrous element different from the first fibrous element, wherein the second fibrous element exhibits a length of less than 5.08 cm, wherein the second fibrous element is a wood pulp fiber; and c. a third layer comprising a third fibrous element different from the first and second fibrous elements, wherein the third fibrous element comprising a hydroxyl polymer selected from the group consisting of: starch, starch derivatives, and mixtures thereof, wherein the third fibrous element exhibits a length of 10.16 cm or greater and a length to average diameter ratio of greater than 2000, wherein the third fibrous element is a second monocomponent filament.

2. The non-wet-laid layered fibrous structure according to claim 1 wherein the hydroxyl polymer of the first fibrous element exhibits a weight average molecular weight of greater than about 10,000 g/mol.

3. The non-wet-laid layered fibrous structure according to claim 1 wherein the first fibrous element exhibits an average diameter of less than 25 μm.

4. The non-wet-laid layered fibrous structure according to claim 1 wherein the first fibrous element exhibits an average diameter of less than 25 μm to greater than 1 μm.

5. The non-wet-laid layered fibrous structure according to claim 1 wherein the hydroxyl polymer of the third fibrous element exhibits a weight average molecular weight of greater than about 10,000 g/mol.

6. The non-wet-laid layered fibrous structure according to claim 5 wherein the hydroxyl polymer of the third fibrous element exhibits a weight average molecular weight of greater than about 100,000 g/mol.

7. The non-wet-laid layered fibrous structure according to claim 1 wherein the hydroxyl polymer of the third fibrous element exhibits a weight average molecular weight of from about 10,000 g/mol to about 40,000,000 g/mol.

8. The non-wet-laid layered fibrous structure according to claim 1 wherein the third fibrous element exhibits an average diameter of less than 25 μm.

9. The non-wet-laid layered fibrous structure according to claim 8 wherein the third fibrous element exhibits an average diameter of less than 10 μm.

10. The non-wet-laid layered fibrous structure according to claim 1 wherein the third fibrous element exhibits an average diameter of less than 25 μm to greater than 1 μm.

11. A non-wet-laid layered fibrous structure comprising at least three layers, wherein the fibrous structure comprises:

a. a first layer comprising a non-thermoplastic, non-cellulose-containing, first fibrous element comprising a starch filament that exhibits a length of 10.16 cm or greater;

b. a second layer comprising a second fibrous element different from the first fibrous element, wherein the second fibrous element exhibits a length of less than 5.08 cm, wherein the second fibrous element is a wood pulp fiber; and c. a third layer comprising a third fibrous element different from the first and second fibrous elements, wherein the third fibrous element comprising a polyvinyl alcohol filament.

12. The non-wet-laid layered fibrous structure according to claim 11 wherein the starch filament comprises a starch that exhibits a weight average molecular weight of greater than about 10,000 g/mol.

13. The non-wet-laid layered fibrous structure according to claim 12 wherein the starch filament comprises a starch that exhibits a weight average molecular weight of greater than about 100,000 g/mol.

14. The non-wet-laid layered fibrous structure according to claim 11 wherein the starch filament comprises a starch that exhibits a weight average molecular weight of greater than about 10,000 g/mol to about 40,000,000 g/mol.

15. The non-wet-laid layered fibrous structure according to claim 11 wherein the starch filament exhibits an average diameter of less than 25 μm.

16. The non-wet-laid layered fibrous structure according to claim 15 wherein the starch filament exhibits an average diameter of less than 10 μm.

17. The non-wet-laid layered fibrous structure according to claim 11 wherein the starch filament exhibits an average diameter of less than 25 μm to greater than 1 μm.

18. The non-wet-laid layered fibrous structure according to claim 11 wherein the polyvinyl alcohol filament comprises a polyvinyl alcohol that exhibits a weight average molecular weight of greater than about 10,000 g/mol.

19. The non-wet-laid layered fibrous structure according to claim 11 wherein the polyvinyl alcohol filament exhibits an average diameter of less than 25 μm.

20. The non-wet-laid layered fibrous structure according to claim 11 wherein the polyvinyl alcohol filament exhibits an average diameter of less than 25 μm to greater than 1 μm.

* * * * *